US010597126B2

(12) United States Patent
Steele et al.

(10) Patent No.: US 10,597,126 B2
(45) Date of Patent: Mar. 24, 2020

(54) WATERCRAFT SECURING SYSTEM AND METHOD OF USE

(71) Applicant: Steele Tribe LLC, Four Seasons, MO (US)

(72) Inventors: Lisa Steele, Four Seasons, MO (US); Larry Steele, Four Seasons, MO (US)

(73) Assignee: STEELE TRIBE LLC, Four Seasons, MO (US)

( * ) Notice: Subject to any disclaimer, the term of this patent is extended or adjusted under 35 U.S.C. 154(b) by 0 days.

(21) Appl. No.: 15/968,247

(22) Filed: May 1, 2018

(65) Prior Publication Data

US 2019/0337599 A1 Nov. 7, 2019

(51) Int. Cl.
*B63B 21/00* (2006.01)
*B63C 1/02* (2006.01)

(52) U.S. Cl.
CPC ..... *B63C 1/02* (2013.01); *B63B 21/00* (2013.01)

(58) Field of Classification Search
CPC ..... B63C 1/02; B63B 21/00; B63B 2021/005; E02B 3/20
See application file for complete search history.

(56) References Cited

U.S. PATENT DOCUMENTS 5,694,879 A * 12/1997 Taylor ..... B63B 21/04 114/230.26
6,216,625 B1 * 4/2001 Baluha ..... B63B 21/00 114/230.27
2016/0145822 A1 * 5/2016 Gerst ..... B63C 1/02 114/263

* cited by examiner

*Primary Examiner* — Andrew Polay
(74) *Attorney, Agent, or Firm* — Thompson Coburn LLP

(57) ABSTRACT

A floating dock includes a frame, a float, and first and second dock posts. The frame has a first longitudinal section and a second longitudinal that define a slip there between. The dock posts are operatively secured to and project upward from the frame and are on opposite sides of the slip. The posts have self-adjusting line systems including a slide, an elongate member, an upper stop, a lower stop, and a line. The slide is slidable along the elongate member between the upper stop and the lower stop. The line is coupled to the slide. The line is adapted to tether the slide to a watercraft. The slides are capable of moving independently to allow vertical translation, pitch, and roll of the watercraft while the watercraft is secured within the slip.

11 Claims, 7 Drawing Sheets

WATERCRAFT SECURING SYSTEM AND METHOD OF USE

CROSS-REFERENCE TO RELATED APPLICATIONS

None.

STATEMENT REGARDING FEDERALLY SPONSORED RESEARCH OR DEVELOPMENT

Not Applicable.

APPENDIX

Not Applicable.

SUMMARY

This section provides a general summary of the disclosure, and is not a comprehensive disclosure of its full scope or all its features.

An aspect of the disclosure relates to a floating dock including a frame, at least one float, first and second dock posts. The at least one float is coupled to the frame and is adapted to support the frame on water. The frame has a first longitudinal section and a second longitudinal. The first longitudinal section is operatively secured to the second longitudinal section. The first and second longitudinal sections of the frame define a slip there between. The slip is sized and configured to receive a watercraft within the slip. The first dock post is operatively secured to and projects upward from the first longitudinal section. The second dock post is operatively secured to and projects upward from the second longitudinal section. The first dock post and the second dock post are positioned on opposite sides of the slip. The first dock post has a first self-adjusting line system, and the second dock post has a second self-adjusting line system. The first self-adjusting line system includes a first slide, a first elongate member, a first upper stop, a first lower stop, and a first line. The first slide is slidable along the first elongate member between the first upper stop and the first lower stop. The first line is coupled to the first slide. The first line being adapted to tether the first slide to a watercraft. The second self-adjusting line system includes a second slide, a second elongate member, a second upper stop, a second lower stop, and a second line. The second slide is slidable along the second elongate member between the second upper stop and the second lower stop. The second line is coupled to the second slide. The second line being adapted to tether the second slide to a watercraft. The first and second self-adjusting line systems are configured such that when a watercraft tethered to the first slide via the first line and tethered to the second slide via the second line moves as a result of wave action, the first slide and the second slide are capable of moving independently to allow vertical translation, pitch, and roll of the watercraft while the watercraft is secured within the slip.

Another aspect of the disclosure relates to a method of fitting self-adjusting line systems to a floating dock. The method includes attaching a first self-adjusting line system to a first dock post of the floating dock. The first dock post is operatively secured to a first longitudinal section of a frame, and the first dock post projects upward from the first longitudinal section. The frame further has a second longitudinal section that is parallel to the first longitudinal section. The first longitudinal section is operatively connected to the second longitudinal section. The first and second longitudinal sections define a slip there between. The first dock post is positioned on a first side of the slip. The first self-adjusting line system includes a first slide, a first elongate member, a first upper stop, a first lower stop, and a first line. The first slide is slidable along the first elongate member between the first upper stop and the first lower stop. The method further includes attaching the first line to the first slide. The method further includes attaching a second self-adjusting line system to a second dock post of the floating dock. The second dock post is operatively secured to the second longitudinal section of the frame, and the second dock post projects upward from the second longitudinal section. The second dock post is positioned on a second side of the slip. The second side of the slip is opposite the first side of the slip. The second self-adjusting line system includes a second slide, a second elongate member, a second upper stop, a second lower stop, and a second line. The second slide is slidable along the second elongate member between the second upper stop and the second lower stop. The second slide is slidable independently of the first slide. The method further includes attaching the second line to the second slide.

These are merely some of the innumerable aspects of the present disclosure and should not be deemed an all-inclusive listing of the innumerable aspects associated with the present disclosure. These and other aspects will become apparent to those skilled in the art in light of the following disclosure and accompanying drawings. The description and specific examples in this summary are intended for purposes of illustration only and are not intended to limit the scope of the present disclosure.

BRIEF DESCRIPTION OF THE DRAWINGS

The accompanying drawings, which are incorporated in and form a part of the specification, illustrate the embodiments of the present disclosure and together with the description, serve to explain the principles of the disclosure.

Reference characters in the written specification indicate corresponding items shown throughout the drawing figures

Figure 1:
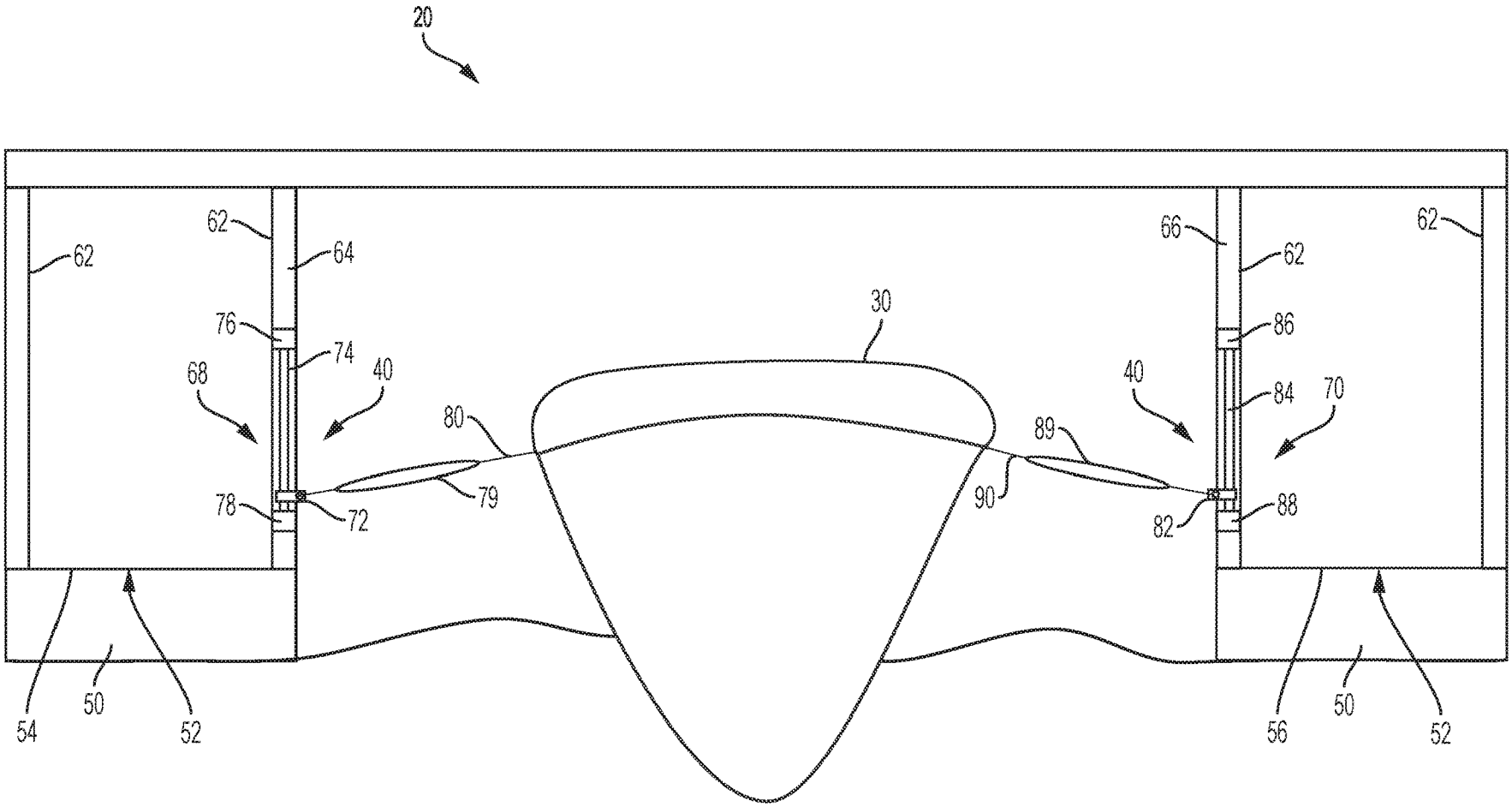
FIG. 1 is a partial, front view of an embodiment of a floating dock with self-adjusting line systems in calm water.

Reference characters in the written specification indicate corresponding items shown throughout the drawing figures.

DETAILED DESCRIPTION

Referring to FIGS. 1-6C generally, a floating dock 20 for securing a watercraft 30 includes a plurality of self-adjusting line systems 40. The various embodiments depicted in the drawings and described below provide several advantages. One advantage is providing a floating dock that is capable of securing a watercraft within a slip even during rough water conditions, for example, caused by wave interference from multiple wave sources (e.g., watercraft). The floating dock and self-adjusting line systems of the disclosure are capable of securing a watercraft during rough water conditions using one or more of a vertical slide and damper included in each self-adjusting line system. As described in greater detail later herein, the slide of each self-adjusting line system is capable of sliding independently and rapidly to account for wave action and secure the watercraft within a slip of the floating dock.

The floating dock 20 includes at least one float 50. Each of the at least one float 50 is configured to float on water to support the other components of the floating dock 20. For example, and without limitation, each of the at least one floats 50 may be a foam block, foam encapsulated by a plastic, or other suitable floating material(s). Each float 50 may be partially submerged. A frame 52 is coupled to the at least one float 50 such that the at least one float 50 supports the frame 52 on the water. The frame 52 includes a first longitudinal section 54 and a second longitudinal section 56, both of which are supported by the at least one float 50. The first longitudinal section 54 and the second longitudinal section 56 are substantially parallel. The first longitudinal section 54 and the second longitudinal section 56 may become misaligned, e.g., not parallel, as a result of wave action.

The first longitudinal section 54 and the second longitudinal section 56 are operatively coupled to one another. For example, and without limitation, the first longitudinal section 54 may be coupled to the second longitudinal section 56 by a transverse section 58 of the frame 52. The first longitudinal section 54 and the second longitudinal section 56 define a slip 60 there between. The slip 60 is sized and configured to receive the watercraft 30 within the slip 60.

The floating dock 20 further includes a plurality of dock posts 62, and includes at least a first dock post 64 and a second dock post 66. Each dock post 62 is operatively secured to and projects upward from the frame 52. For example, and without limitation, one or more dock posts 62 extends upward from the frame 52 to support a roof. In alternative embodiments, the floating dock 20 does not include a roof. In such embodiments, one or more dock posts 62 may extend upward from the frame to support cleats or other components. In still further embodiments, one or more dock posts extends upward only to a deck and may support the deck.

The first dock post 64 is operatively secured to and projects upward from the first longitudinal section 54. The second dock post 66 is operatively secured to and projects upward from the second longitudinal section 56. The first dock post 64 is on an opposite side of the slip 60 than the second dock post 66. The first dock post 64 includes a first self-adjusting line system 68. For example, and without limitation, the first self-adjusting line system 68 is bolted to the first dock post 64, welded to the first dock post 64, or otherwise coupled to the first dock post 64. In alternative embodiments, the first self-adjusting line system 68 is at least partially formed with the first dock post 64. For example, and without limitation, an elongate member along which a slide is capable of sliding is formed into and as a part of the first dock post 64. The second dock post 66 includes a second self-adjusting line system 70. For example, and without limitation, the second self-adjusting line system 70 is bolted to the second dock post 66, welded to the second dock post 66, or otherwise coupled to the second dock post 66. In alternative embodiments, the second self-adjusting line system 70 is at least partially formed with the second dock post 66. For example, and without limitation, an elongate member along which a slide is capable of sliding is formed into and as a part of the first dock post 66.

The first self-adjusting line system 68 includes a first slide 72, a first elongate member 74, a first upper stop 76, a first lower stop 78, and a first line 80. The first slide 72 is slidable along the first elongate member 74 between the first upper stop 76 and the first lower stop 78. The first line 80 is coupled to the first slide 72. The first line 80 is capable of being coupled, directly or indirectly, to the watercraft 30.

In some alternative embodiments, the first self-adjusting line system 68 further includes a first damper 79. In such embodiments, the first line 80 passes through the first damper 79 or is otherwise coupled to the first line 80. The first damper 79 is configured to damp a varying tension force in the first line 80 caused by movement of the watercraft 30 resulting from wave action. For example, and without limitation, the first damper 79 may be a snubber or another suitable damper.

The second self-adjusting line system 70 includes a second slide 82, a second elongate member 84, a second upper stop 86, a second lower stop 88, and a second line 90. The second slide 82 is slidable along the second elongate member 84 between the second upper stop 86 and the second lower stop 88. The second line 90 is coupled to the first slide 82. The second line 90 is capable of being coupled, directly or indirectly, to the watercraft 30.

In some alternative embodiments, the second self-adjusting line system 70 further includes a second damper 89. In such embodiments, the second line 90 passes through the second damper 89 or is otherwise coupled to the second line 90. The second damper 89 is configured to damp a varying tension force in the second line 90 caused by movement of the watercraft 30 resulting from wave action. For example, and without limitation, the second damper 89 may be a snubber or other suitable damper.

Figure 2:
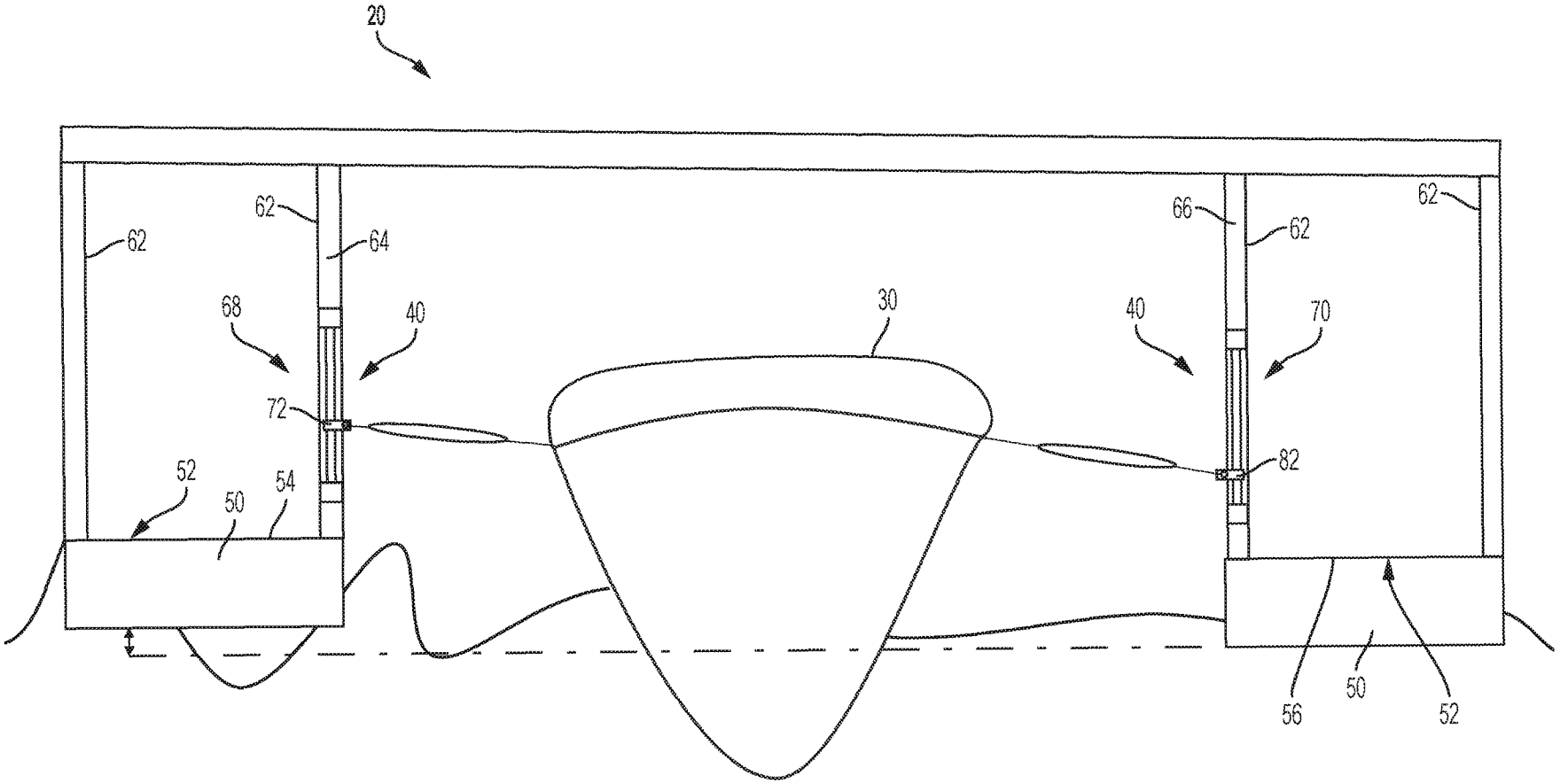
FIG. 2 is a partial, front view of the floating dock and self-adjusting line systems shown in FIG. 1 in rougher water conditions in which the floating dock is partially displaced upward by wave action.
Figure 3:
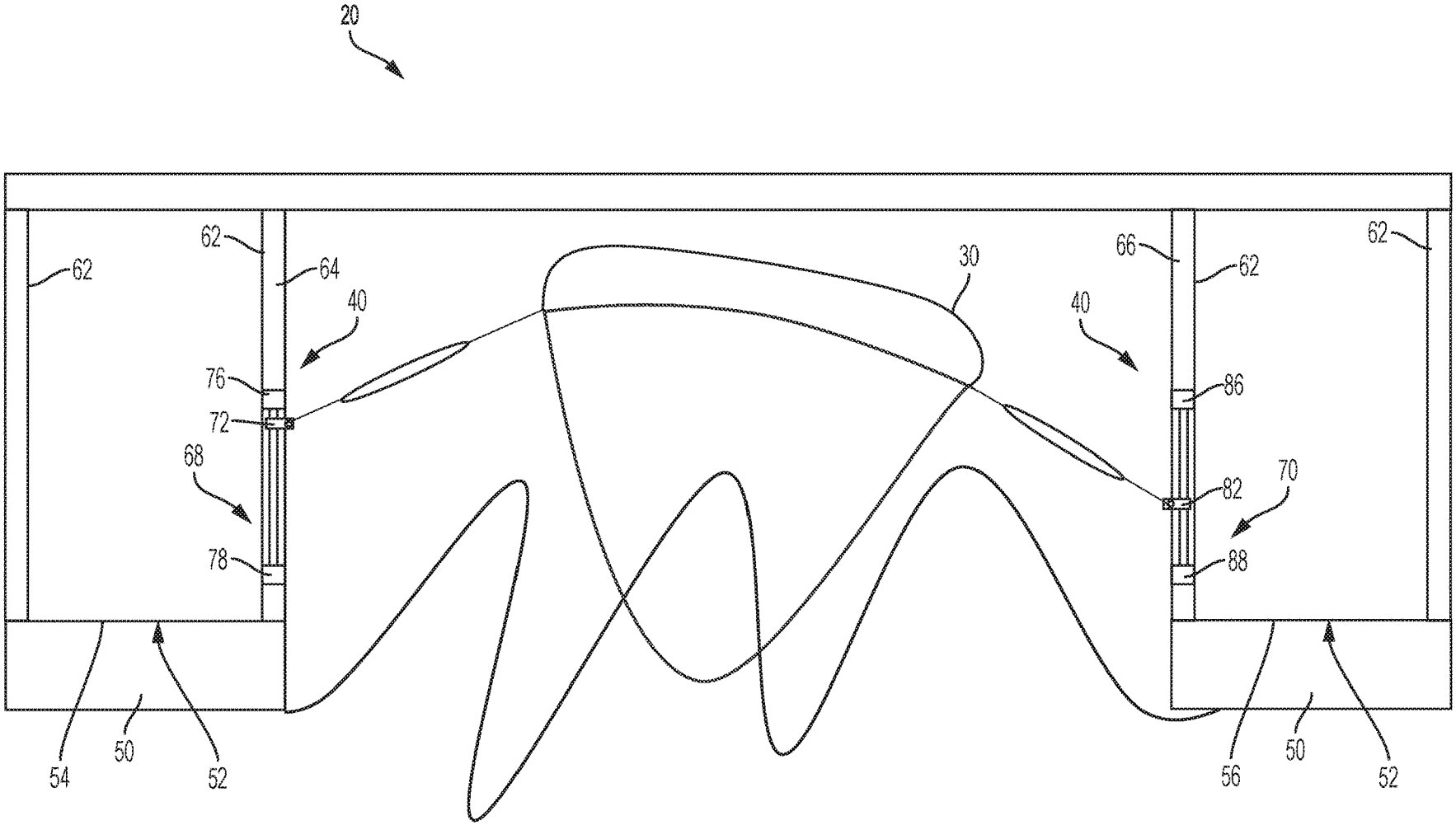
FIG. 3 is a partial, front view of the floating dock and self-adjusting line system shown in FIG. 1 in rougher water conditions, caused for example by wave interference from multiple wave sources.
Figure 4:
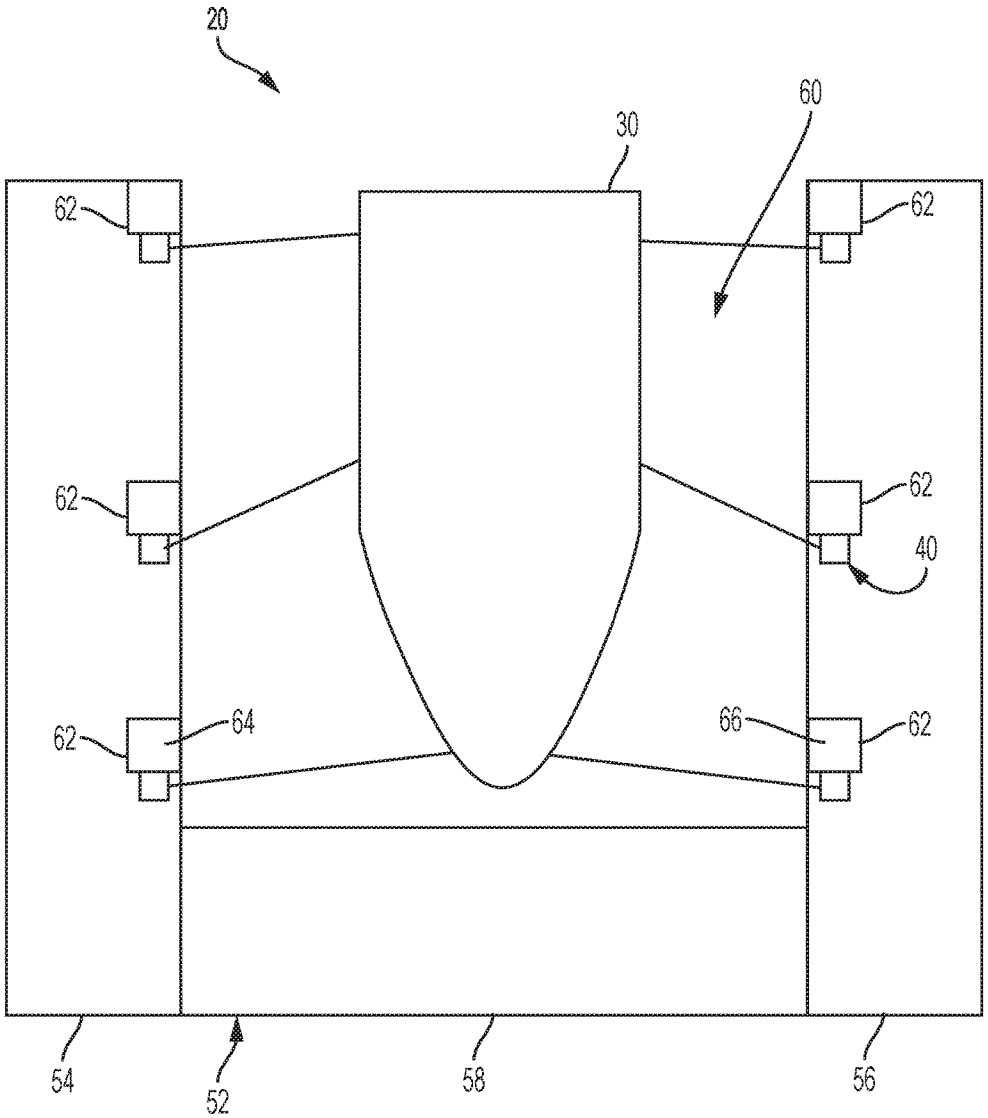
FIG. 4 is a partial, top, schematic view of the floating dock and self-adjusting line systems shown in FIG. 1.
Figure 5B:
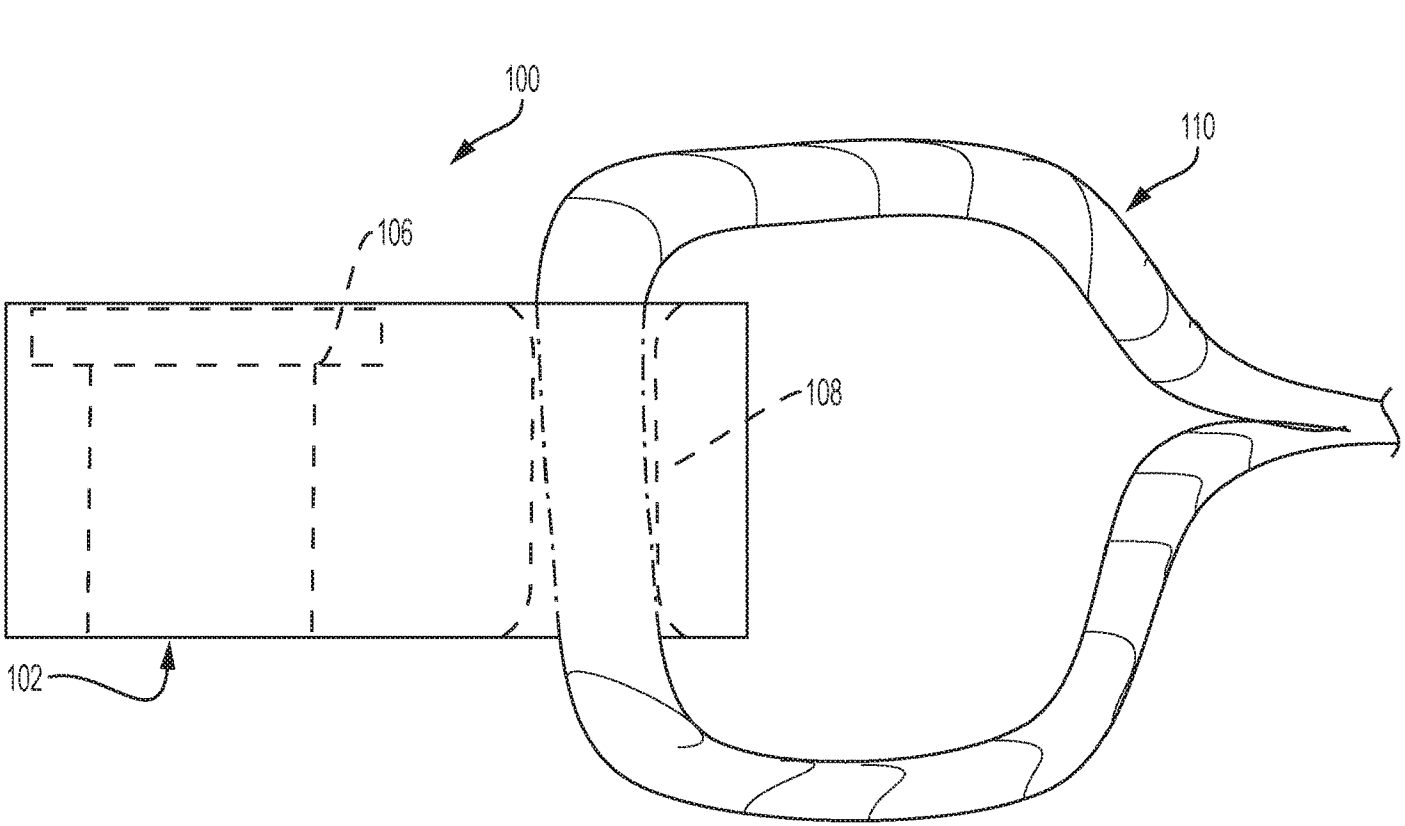
FIG. 5B is a detailed front view of a slide of the self-adjusting line system shown in FIG. 5A.
Figure 5A:
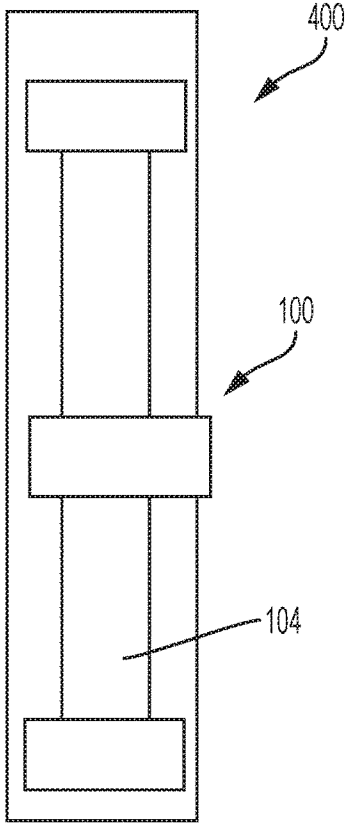
FIG. 5A is a front view of a portion of the self-adjusting line system shown in FIG. 1.
Figure 6C:
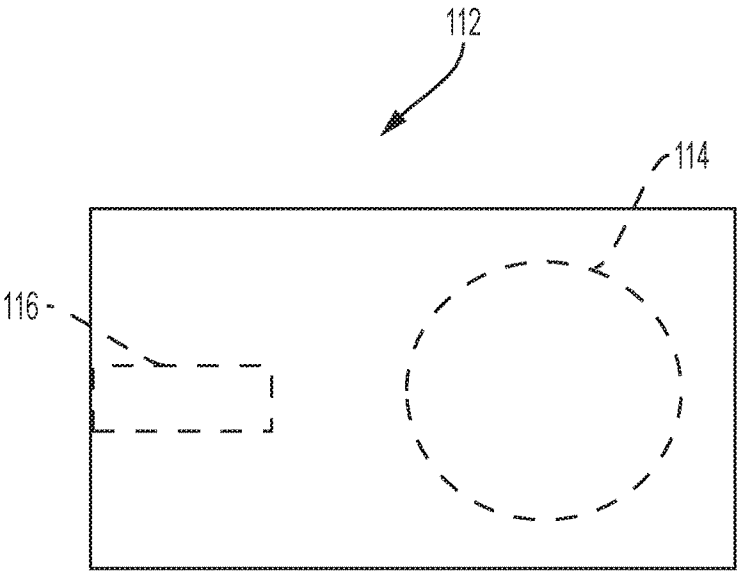
FIG. 6C is a detailed top view of the securing cap shown in FIG. 6B.
Figure 6B:
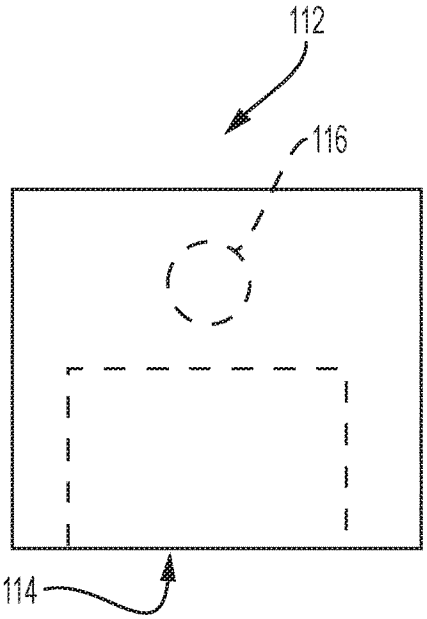
FIG. 6B is a detailed elevation, front view of a securing cap of the self-adjusting line system shown in FIG. 6A.
Figure 6A:
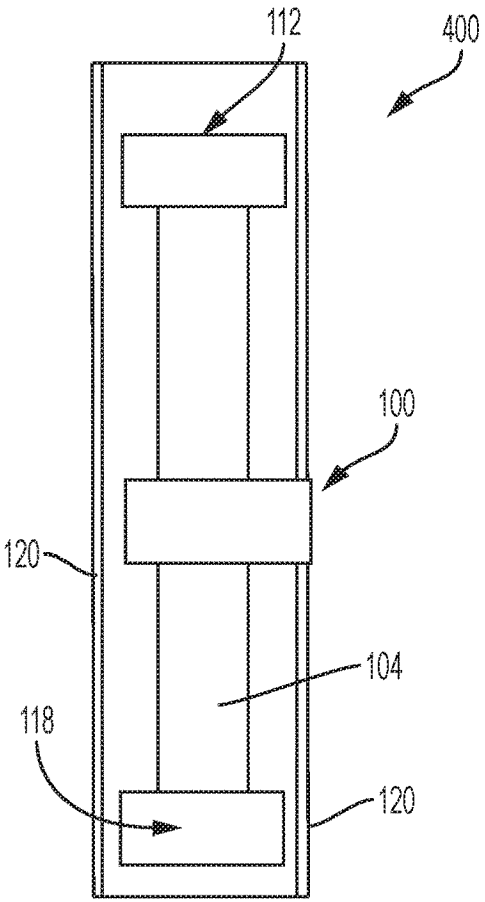
FIG. 6A is a front view of a portion of the self-adjusting line system shown in FIG. 1.

The first and second self-adjusting line systems 68, 70 are configured to couple, in a releasable manner, to the watercraft 30 to secure the watercraft 30 within the slip 60 and accommodate rough wave action. The first and second self-adjusting line systems 68, 70 accommodate rough wave action through movement of the first and second slides 72, 82 relative to the frame 52 and along the first and second elongate members 74, 84. The first slide 72 and the second slide 82 are capable of moving independently to allow vertical translation, pitch, and/or roll of the watercraft 30 while the watercraft 30 is secured within the slip 60. For example, and without limitation, the first slide 72 and the second slide 82 may be positioned an equal distance from their respective lower stops 78, 88 when the watercraft 30 and floating dock 20 are in relatively calm waters (e.g., low amplitude waves) as depicted in FIG. 1. In rougher water conditions (e.g., caused by one or more waves), as shown in FIG. 2, the floating dock 20 may be displaced. In such a case, the first slide 72 may move independently of the second slide 82, which may also move, resulting in the first slide 72 and the second slide 82 being positioned at unequal distances from their respective lower stops 78, 88. This allows for the self-adjusting line systems 40 to compensate for the rough water and the movement of the floating dock 20 while securing the watercraft 30 within the slip 60. In still rougher water conditions (e.g., caused by multiple waves from multiple other watercraft interfering with one another), the self-adjusting line systems 40 adjust to keep the watercraft 30 secured within the slip 60 (e.g., as shown in FIG. 3). In such a case, the first slide 72 and the second slide 82 may be positioned at unequal distances from their respective lower stops 78, 88. Furthermore, one or more of the slides 72, 82 may be prevented from further movement by the corresponding upper stop 76, 86 or lower stop 78, 88.

In some embodiments, the floating dock 20 includes additional self-adjusting line systems 40 that function as described with reference to the first and second self-adjusting line systems 68, 70. For example, and without limitation, the floating dock system may include three, four, six, or more self-adjusting line systems 40. While the self-adjusting line systems 40 are typically present in pairs (e.g., one on each side of the slip 60), any number and positioning of the self-adjusting line systems 40 may be included in a floating dock 20. The self-adjusting line systems 40 may or may not include dampers.

For example, the floating dock 20 may include four self-adjusting line systems 40. A first pair of self-adjusting line systems 40 secure the bow of the watercraft 30 with each self-adjusting line system 40 positioned on opposite sides of the slip 60. A second pair of self-adjusting line systems 40 secures the stern of the watercraft 30 with each self-adjusting line system 40 positioned on opposite sides of the slip 60. In further embodiments, the floating dock 20 may further include an additional pair of self-adjusting line systems 40 that secure the midship of the watercraft 30 with each self-adjusting line system 40 positioned on opposite sides of the slip 60.

Referring to FIGS. 5A-6C, an embodiment of a self-adjusting line system 400 is shown in greater detail according to one embodiment. The self-adjusting line system 400 is one embodiment of the self-adjusting line systems 40 as described herein. A slide 100 has a through hole 102 sized to accommodate an elongate member 104. The through hole 102 and the elongate member 104 are both circular in cross-section. In alternative embodiments, the through hole 102 and/or the elongate member 104 have alternative cross-sections. A bushing 106 is positioned between the elongate member 104 and the slide 100, with the bushing inserted within the through hole 102. The slide 100 includes a second through hole 108 through which a line 110 extends. The line 110 capable of tethering the slide 100 to the watercraft 30.

The upper stop 112 of the self-adjusting line system 400 includes a cylindrical cavity 114 into which the elongate member 104 extends. The elongate member 104 is captive within the cylindrical cavity 114. The upper stop 112 further includes a threaded cavity 116 for bolting the upper stop 112 to a dock post. The bolt passes through the dock post secured by its head on one side and threads into the threaded cavity 116 to secure the upper stop 112 to the dock post. Advantageously, this connection is made without nuts or washers while maintaining the same function. A lower stop 118 of the self-adjusting line system 400 may be identical to the upper stop 112 but be installed in an inverted orientation to secure the elongate member 104 within the cylindrical cavity 114.

Optionally, the self-adjusting line system 400 includes one or more guards 120 in some embodiments. For example, and without limitation, the guards 120 may be positioned on opposite sides of the self-adjusting line system 400 and extend outwards to partially surround the elongate member 104. The guards 120 may limit access to the elongate member 104.

Figure 7C:
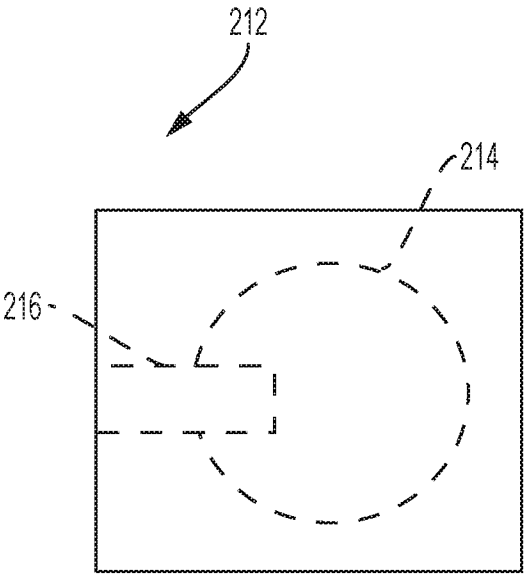
FIG. 7C is a detailed top view of the securing cap shown in FIG. 7B.
Figure 7B:
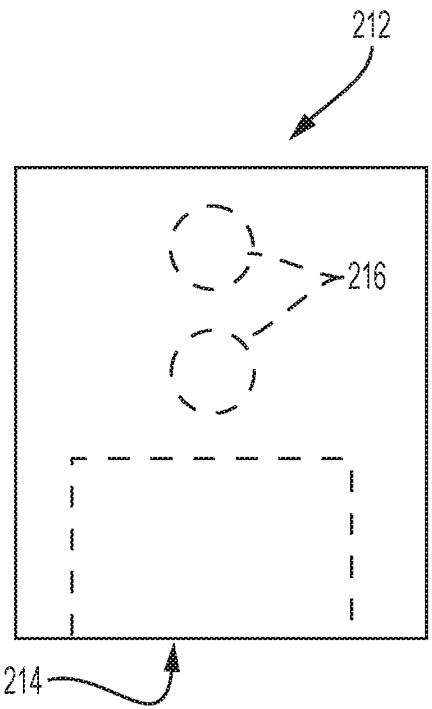
FIG. 7B is a detailed elevation, front view of a securing cap of the self-adjusting line system shown in FIG. 7A.
Figure 7A:
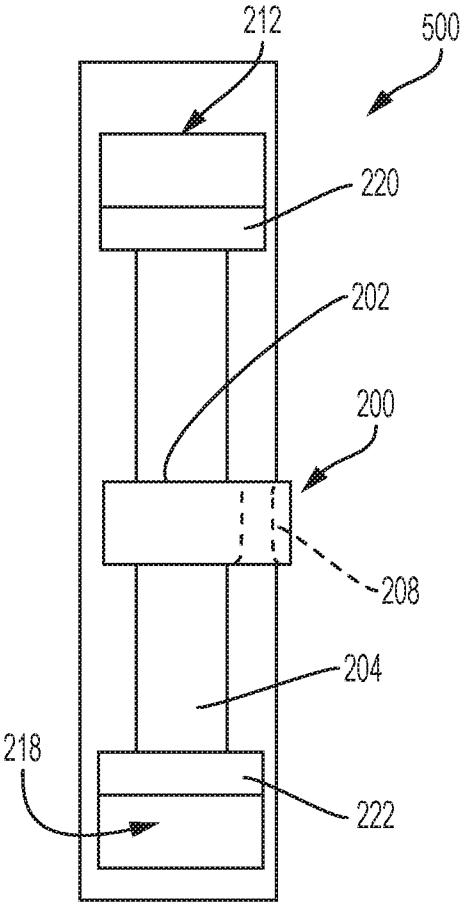
FIG. 7A is a front view of a portion of a self-adjusting line system.

Referring to FIGS. 7A-7C, an embodiment of a self-adjusting line system 500 is shown in greater detail according to one embodiment. The self-adjusting line system 500 is one embodiment of the self-adjusting line systems 40 as described herein. A slide 200 has a through hole 202 sized to accommodate an elongate member 204. The through hole 202 and the elongate member 204 are both circular in cross-section. In alternative embodiments, the through hole 202 and/or the elongate member 204 have alternative cross-sections. A bushing may be positioned between the elongate member 204 and the slide 200, with the bushing inserted within the through hole 202. The slide 200 includes a second through hole 208 through which a line may extend. The line is capable of tethering the slide 200 to the watercraft 30.

The upper stop 212 of the self-adjusting line system 500 includes a cylindrical cavity 214 into which the elongate member 204 extends. The elongate member 204 is captive within the cylindrical cavity 214. The upper stop 212 further includes two threaded cavities 216 for bolting the upper stop 212 to a dock post. The bolt passes through the dock post secured by its head on one side and threads into the threaded cavity 216 to secure the upper stop 212 to the dock post. Advantageously, this connection is made without nuts or washers while maintaining the same function. A lower stop 218 of the self-adjusting line system 500 may be identical to the upper stop 212 but be installed in an inverted orientation to secure the elongate member 204 within the cylindrical cavity 214.

The self-adjusting line system 500 further includes an upper rubber stopper 220 and a lower rubber stopper 222. The upper rubber stopper 220 is positioned about elongate member 204 and adjacent the upper stop 212. The lower rubber stopper 222 is positioned about elongate member 204 and adjacent the lower stop 218. Each of the upper rubber stopper 220 and the lower rubber stopper 222 are adapted and configured to prevent direct contact between the slide 200 and the corresponding stop. Advantageously, this reduces the noise produced by the self-adjusting line system 500 when in operation by preventing metal on metal contact of the slide 200 contacting either stop 212, 218. The upper rubber stopper 220 and the lower rubber stopper 222 may also cushion the slide 200 as it reaches the upper and lower extremes of its path of travel. This may increase the life of the self-adjusting line system 500. Each of the upper and lower rubber stopper may be made of any suitable non-metallic material including, but not limited to, rubber or polyurethane.

Referring to FIGS. 1-7C, in operation the self-adjusting line systems 40 are installed on the dock posts by attaching at least two self-adjusting line systems 40 to two dock posts 62. The dock posts 62 may be on the same side (e.g., on the same side of a floating dock with only one longitudinal section) or on opposing sides (e.g., starboard and port) of the slip 60. A line is attached to one of the self-adjusting line systems 40 and is also attached to a damper. A second line is attached to the other of the self-adjusting line systems 40. This may be repeated for any number of self-adjusting line systems 40 to be installed on a floating dock 20. To secure a watercraft 30 within the slip 60, the slides of the self-adjusting line systems 40 are tethered to the watercraft using the lines. Typically, a pair of self-adjusting line systems 40 with each individual system on opposite sides of the slip 60 will be coupled to the watercraft 30 in the same longitudinal portion of the watercraft 30. In other words, a first self-adjusting line system 40 will be tethered to a starboard bow cleat and a second self-adjusting line system 40 on the other side of the slip 60 will be tethered to a port bow cleat. The same procedure may be repeated for any number of self-adjusting line systems 40 and other portions of the watercraft 30 (e.g., midship, stern, etc.). The self-adjusting line systems 40 secure the watercraft 30 within the slip 60 during rough wave action through at least the independent movement of the slides.

The embodiments were chosen and described in order to best explain the principles of the disclosure and its practical application to thereby enable others skilled in the art to best utilize the disclosure in various embodiments and with various modifications as are suited to the particular use contemplated.

As various modifications could be made in the constructions and methods herein described and illustrated without departing from the scope of the disclosure, it is intended that all matter contained in the foregoing description or shown in the accompanying drawings shall be interpreted as illustrative rather than limiting. Thus, the breadth and scope of the present disclosure should not be limited by any of the above-described exemplary embodiments, but should be defined only in accordance with the following claims appended hereto and their equivalents.

What is claimed is:

1. A floating dock comprising:

a frame;

at least one float;

first and second dock posts; and first and second self-adjusting line systems, each of the first and second self-adjusting line systems comprising a slide, an elongate member, an upper stop, a lower stop, a line, and a damper, the slide being slidable along the elongate member between the upper stop and the lower stop, the line being adapted to tether the slide to a watercraft, the line passing through the damper, the damper being configured to damp a varying tension force in the line caused by movement of a watercraft resulting from wave action;

the at least one float being coupled to the frame, the at least one float being adapted to support the frame on water, the frame having a first longitudinal section and a second longitudinal section, the first longitudinal section operatively secured to the second longitudinal section, the first and second longitudinal sections of the frame defining a slip therebetween, the slip being sized and configured to receive a watercraft within the slip, the first dock post secured in a fixed vertical position relative to and projecting upward from the first longitudinal section, the second dock post secured in a fixed vertical position relative to and projecting upward from the second longitudinal section, the first dock post and the second dock post being positioned on opposite sides of the slip, the first self-adjusting line system being attached to the first dock post, the second self-adjusting line system being attached to the second dock post, and the first and second self-adjusting line systems configured such that when a watercraft tethered to the first slide via the first line and tethered to the second slide via the second line moves as a result of wave action the first slide and the second slide are capable of moving independently to allow vertical translation, pitch, and roll of the watercraft while the watercraft is secured within the slip.

2. A floating dock in accordance with claim 1 further comprising a third self-adjusting line system and a fourth self-adjusting line system, the first and second self-adjusting line systems positioned relative to the slip to secure a bow of a watercraft, the third and fourth self-adjusting line systems positioned on opposite sides of the slip and positioned relative to the slip to secure a stern of a watercraft, the third self-adjusting line system comprising a third slide, a third elongate member, a third upper stop, a third lower stop, a third line, and a third damper, the third slide being slidable along the third elongate member between the third upper stop and the third lower stop, the third line being adapted to tether the third slide to a watercraft, the third line passing through the third damper, the third damper being configured to damp a varying tension force in the third line caused by movement of a watercraft resulting from wave action, and the fourth self-adjusting line system comprising a fourth slide, a fourth elongate member, a fourth upper stop, a fourth lower stop, a fourth line, and a fourth damper, the fourth slide being slidable along the fourth elongate member between the fourth upper stop and the fourth lower stop, the fourth line being adapted to tether the fourth slide to a watercraft, the fourth line passing through the fourth damper, the fourth damper being configured to damp a varying tension force in the fourth line caused by movement of a watercraft resulting from wave action, the third slide and the fourth slide capable of moving independently.

3. A floating dock in accordance with claim 2 further comprising a fifth self-adjusting line system and a sixth self-adjusting line system, the fifth and sixth self-adjusting line systems positioned on opposite sides of the slip and positioned relative to the slip to secure a midship of a watercraft, the fifth self-adjusting line system comprising a fifth slide, a fifth elongate member, a fifth upper stop, a fifth lower stop, a fifth line, and a fifth damper, the fifth slide being slidable along the fifth elongate member between the fifth upper stop and the fifth lower stop, the fifth line being adapted to tether the fifth slide to a watercraft, the fifth line passing through the fifth damper, the fifth damper being configured to damp a varying tension force in the fifth line caused by movement of a watercraft resulting from wave action, and the sixth self-adjusting line system comprising a fourth slide, a sixth elongate member, a sixth upper stop, a sixth lower stop, a sixth line, and a sixth damper, the sixth slide being slidable along the sixth elongate member between the sixth upper stop and the sixth lower stop, the sixth line being adapted to tether the sixth slide to a watercraft, the sixth line passing through the sixth damper, the sixth damper being configured to damp a varying tension force in the sixth line caused by movement of a watercraft resulting from wave action, the fifth slide and the sixth slide capable of moving independently.

4. A floating dock in accordance with claim 1, the first self-adjusting line system further comprising a first upper stopper and a first lower stopper, the first upper stopper positioned about the first elongate member and adjacent the first upper stop, the first lower stopper positioned about the first elongate member and adjacent the first lower stop, the second self-adjusting line system further comprising a second upper stopper and a second lower stopper, the second upper stopper positioned about the second elongate member and adjacent the second upper stop, the second lower stopper positioned about the second elongate member and adjacent the second lower stop.

5. A method of fitting self-adjusting line systems to a floating dock comprising:

attaching a first self-adjusting line system to a first dock post of the floating dock, the first dock post being secured in a fixed vertical position relative to a first longitudinal section of a frame, the first dock post projecting upward from the first longitudinal section, the frame further having a second longitudinal section, the first longitudinal section being operatively secured to the second longitudinal section, the first and second longitudinal sections defining a slip there between, the first dock post positioned on a first side of the slip, the first self-adjusting line system comprising a first slide, a first elongate member, a first upper stop, a first lower stop, a first line, and a first damper, the first slide being slidable along the first elongate member between the first upper stop and the first lower stop;

attaching the first line to the first slide;

attaching the first damper to the first line such that the first line passes through the first damper, the first damper being configured to damp a varying tension force in the first line caused by movement of a watercraft resulting from wave action;

attaching a second self-adjusting line system to a second dock post of the floating dock, the second dock post being secured in a fixed vertical position relative to the second longitudinal section of the frame, the second dock post projecting upward from the second longitudinal section, the second dock post positioned on a second side of the slip, the second side of the slip being opposite the first side of the slip, the second self-adjusting line system comprising a second slide, a second elongate member, a second upper stop, a second lower stop, a second line, and a second damper, the second slide being slidable along the second elongate member between the second upper stop and the second lower stop, the second slide being slidable independently of the first slide;

attaching the second line to the second slide; and attaching the second damper to the second line such that the second line passes through the second damper, the second damper being configured to damp a varying tension force in the second line caused by movement of a watercraft resulting from wave action.

6. A method in accordance with claim 5 further comprising tethering the first line to a watercraft and tethering the second line to the watercraft.

7. A method in accordance with claim 6 wherein tethering the first line to the watercraft comprises tethering the first line to a starboard bow portion of the watercraft, and wherein tethering the second line to the watercraft comprises tethering the second line to a port bow portion of the watercraft.

8. A method in accordance with claim 5 further comprising:

attaching a third self-adjusting line system to a third dock post of the floating dock, the third dock post being operatively secured to the frame, the third dock post projecting upward from the frame, the third self-adjusting line system comprising a third slide, a third elongate member, a third upper stop, a third lower stop, a third line, and a third damper, the third slide being slidable along the third elongate member between the third upper stop and the third lower stop;

attaching the third line to the third slide; and attaching the third damper to the third line such that the third line passes through the third damper, the third damper being configured to damp a varying tension force in the third line caused by movement of a watercraft resulting from wave action;

attaching a fourth self-adjusting line system to a fourth dock post of the floating dock, the fourth dock post being operatively secured to the frame, the fourth dock post projecting upward from the frame, the fourth self-adjusting line system comprising a fourth slide, a fourth elongate member, a fourth upper stop, a fourth lower stop, a fourth line, and a fourth damper, the fourth slide being slidable along the fourth elongate member between the fourth upper stop and the fourth lower stop;

attaching the fourth line to the fourth slide; and attaching the fourth damper to the fourth line such that the fourth line passes through the fourth damper, the fourth damper being configured to damp a varying tension force in the fourth line caused by movement of a watercraft resulting from wave action.

9. A method in accordance with claim 8 further comprising tethering the third line to a starboard stern portion of the watercraft, and tethering the fourth line to a port stern portion of the watercraft.

10. A method in accordance with claim 8 further comprising:

attaching a fifth self-adjusting line system to a fifth dock post of the floating dock, the fifth dock post being operatively secured to the frame, the fifth dock post projecting upward from the frame, the fifth self-adjusting line system comprising a fifth slide, a fifth elongate member, a fifth upper stop, a fifth lower stop, a fifth line, and a fifth damper, the fifth slide being slidable along the fifth elongate member between the fifth upper stop and the fifth lower stop;

attaching the fifth line to the fifth slide; and attaching the fifth damper to the fifth line such that the fifth line passes through the fifth damper, the fifth damper being configured to damp a varying tension force in the fifth line caused by movement of a watercraft resulting from wave action;

attaching a sixth self-adjusting line system to a sixth dock post of the floating dock, the sixth dock post being operatively secured to the frame, the sixth dock post projecting upward from the frame, the sixth self-adjusting line system comprising a sixth slide, a sixth elongate member, a sixth upper stop, a sixth lower stop, a sixth line, and a sixth damper, the sixth slide being slidable along the sixth elongate member between the sixth upper stop and the sixth lower stop;

attaching the sixth line to the sixth slide; and attaching the sixth damper to the sixth line such that the sixth line passes through the sixth damper, the sixth damper being configured to damp a varying tension force in the sixth line caused by movement of a watercraft resulting from wave action.

11. A method in accordance with claim 10 further comprising tethering the fifth line to a starboard midship portion of the watercraft, and tethering the sixth line to a port midship portion of the watercraft.

* * * * *